United States Patent [19]

Kern

[11] 3,953,376

[45] Apr. 27, 1976

[54] METHOD FOR PREPARING EMISSIVE COATING FOR ELECTRODES

[75] Inventor: Edmund R. Kern, Hampton, N.H.

[73] Assignee: International Telephone and Telegraph Corporation, Nutley, N.J.

[22] Filed: July 10, 1974

[21] Appl. No.: 487,409

[52] U.S. Cl. ..... 252/521; 252/500; 423/593

[51] Int. Cl.[2] ..... H01B 1/06

[58] Field of Search ..... 252/521; 423/593; 117/223; 428/378, 389, 371, 403

[56] References Cited

UNITED STATES PATENTS

| | | | |
|---|---|---|---|
| 2,724,070 | 11/1955 | Heine et al. | 252/521 X |
| 2,985,548 | 5/1961 | Blickwedel | 117/223 X |
| 3,718,831 | 2/1973 | Butter et al. | 313/346 R |
| 3,755,553 | 8/1973 | Kutolin et al. | 423/593 X |
| 3,758,809 | 9/1973 | Menelly et al. | 313/346 R |
| 3,766,423 | 10/1973 | Menelly | 313/311 |
| 3,798,492 | 3/1974 | Menelly | 313/346 R |
| 3,837,909 | 9/1974 | Menelly | 117/224 |
| 3,842,469 | 10/1974 | Menelly | 29/25.11 |

*Primary Examiner*—Benjamin R. Padgett
*Assistant Examiner*—E. Suzanne Parr
*Attorney, Agent, or Firm*—John T. O'Halloran; Menotti J. Lombardi, Jr.; Richard A. Menelly

[57] ABSTRACT

An electron emissive coating for long life fluorescent lamps comprises a composition of barium tantalate having the formula $M(BaO) \cdot N(Ta_2O_5)$ where the ratio M/N is greater than 1.

2 Claims, 7 Drawing Figures

METHOD FOR PREPARING EMISSIVE COATING FOR ELECTRODES

BACKGROUND OF THE INVENTION

Fluorescent lamps generally consist of a tubular envelope with electrodes sealed at both ends with a coating of fluorescent material on the inner surface of the envelope and a mixture of vaporizable metal in an inert gas. A small quantity of electron emissive coating is applied to the surface of both electrodes in order to facilitate the emission of electrons. When a suitable voltage is applied across the fluorescent lamp to the electrodes the electrons which leave the electrodes consitute the electrical current through the lamp by the complex mechanism of ionization by collision. The electrons by the process of electron avalanche increasingly multiply to such an extent that the discharge current through the lamp is capable of excessively heating the electrodes to a point of destruction. A lamp current limiting device is therefore generally incorporated in the lamp operating circuit in order to ballast the current flow through the lamp to a reasonable value.

The operating life of the lamp is generally determined by the quantity of electron emissive coating available on the cathode emissive surface. For a fixed lamp operating voltage lamps are generally designed to be able to provide for both the emission of electrons from the cathodes and the generation of the above mentioned discharge current through the lamp. The electron emissive coating becomes depleted by successively starting and operating the lamp over a number of continuous cycles; or by the operation of a lamp current in excess of the design capabilities of the electrode structure. When the lamp is successively started over a substantial number of operative cycles the electrode coating material becomes dissipated by the local high energy fields which constitute the cathode fall region in the close vicinity of the cathodes. In the case of lamp operating currents in excess of the electrode coil design the cathode coating becomes depleted by the means of the excess operating temperatures of the cathodes causing the subsequent rapid evaporation of the emissive material.

In a well-designed lamp of the type having a ballast for providing the correct lamp operating current, and electrodes properly designed to meet the rated lamp life, lamp life then becomes a sensitive function of the quantity of electron emissive material present initially upon the electrodes so that lamp failure mainly occurs when the emissive coating becomes depleted from one or both electrodes. This invention therefore provides a cathode emissive coating material that results in large quantities of electron emissive material when applied to fluorescent lamp electrodes with correspondingly increased lamp operating life.

SUMMARY OF THE INVENTION

Barium tantalate emissive coatings having a barium oxide to tantalum pentoxide ratio of 5 to 1 provide large quantities of emissive coating to fluorescent lamp electrodes and result in substantially increased lamp operating life. The barium tantalate emissive mixture is formulated to have a concentration of $M(BaO) . N(Ta_2O_5)$ where M is larger than N. A quantity of barium carbonate and tantalum pentoxide is heated within a suitable container to a first reaction temperature of 800°C. The barium-tantalum compound is kept at this temperature for a predetermined amount of time and then brought to 1200°C for roughly twice the amount of time than that at 800°C. The resultant tantalate is then cooled and mixed with a small quantity of calcium carbonate before dispersing within a nitrocellulose binder for application to fluorescent lamp electrodes in the usual manner.

DESCRIPTION OF THE PREFERRED EMBODIMENTS

One embodiment of the instant electrode emissive coating was prepared in the following manner. Commercial grade barium carbonate powder was added to an equivalent grade tantalum pentoxide powder resulting in a 70 gram mixture with the molar ratio of barium carbonate to tantalum pentoxide of 5 to 1. The mixture was then ball-milled for 4 hours in a methanol slurry in order to homogeneously mix the carbonate and pentoxide. The resultant material was then allowed to dry in an oven sufficiently warm to evaporate the methanol without changing the chemistry of the tantalum pentoxide-barium carbonate mixture. To facilitate subsequent handling the material when dried was pressed into one and one-half inch slugs at approximately 4000 pounds pressure. The slugs were then put into an alumina crucible and heated at 800°C for 1 hour. The barium compound was therefore caused to react chemically with the tantalum pentoxide by raising the temperature to 1200°C and allowing the material to remain for 2 hours at this temperature before cooling. After the reaction was completed and the material was sufficiently cooled samples of the resultant barium tantalate compound were identified both petrographically and by x-ray defraction to have a structure consisting mainly of $5\ BaO . Ta_2O_5$. Although other ratios of BaO to $Ta_2O_5$ were present the ratio of BaO to $Ta_2O_5$ was in all cases in excess of 1.0. In order to prepare a coating suspension for application to the lamp electrodes the tantalate was ball-milled to a mean particle diameter of approximately 6 microns and 10% calcium carbonate was added to the tantalate. The calcium carbonate is added to prevent the formation of end discoloration when the lamp is operated on test-cycle burning conditions. The calcium carbonate-barium tantalate mix was then processed in a roller mill to which a solution of nitrocellulose binder in amyl acetate solvent was added to produce a coating suspension having the similar adhesive and drying properties of standard type emissive coating suspensions. The use of a binder for adhering the tantalate to the coil is unnecessary since the powder adheres from a wet application out of a suspension of solvent alone but is included here for test comparisons to the regular coating which requires a binder for adhesion.

A batch of standard cathode coating emissive material was prepared as a control group for comparison with the inventive emissive coating. The mixture of triple carbonates having approximate molar ratios of barium carbonate 45%, strontium carbonate 45% and calcium carbonate 10% were suspended into a nitrocellulose binder with an amyl acetate solvent in a separate roller mill and milled to the same measured particle size distribution as the inventive barium tantalate coating. The triple carbonate coating is the industry standard type coating currently used in most fluorescent lamp types.

Figure 1:
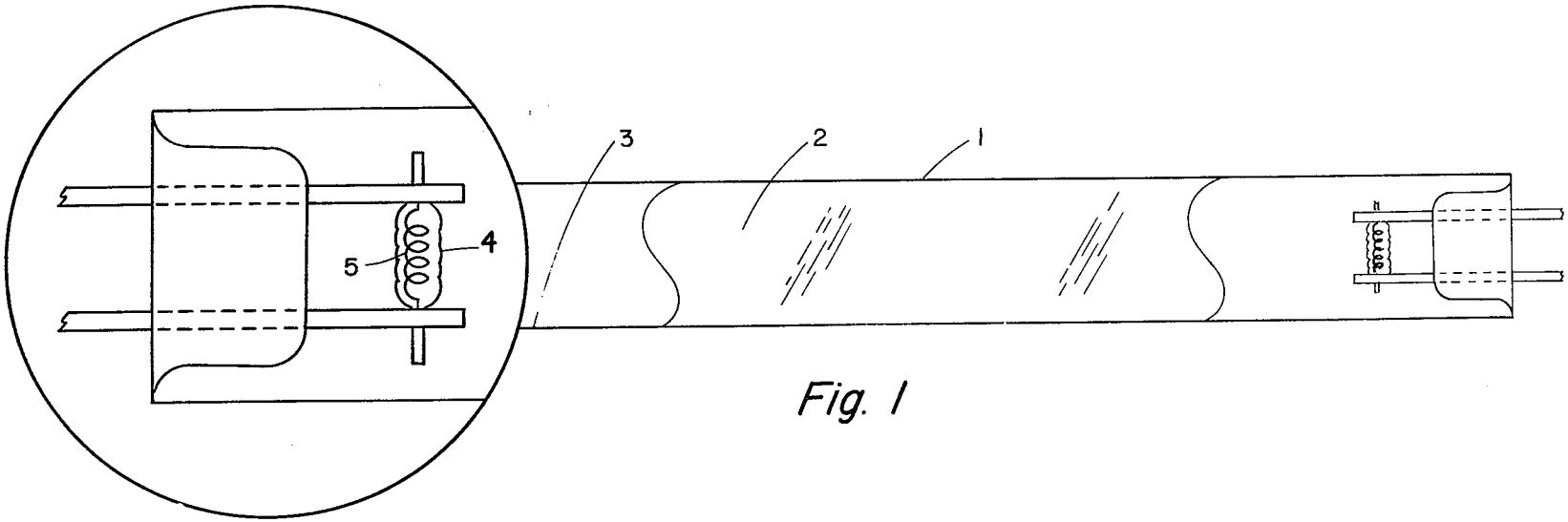
FIG. 1 is a fluorescent lamp with the phosphor coating removed to show the electrode structure.

FIG. 1 shows a High Output fluorescent lamp 1, hereinafter referred to as H.O., designed to operate at 800 miliamperes lamp current. The phosphor coating 2 usually present on the inner surface 3 is partially removed to allow pyrometric measurements of the emission coating 4 and the supporting coil 5.

Figure 4:
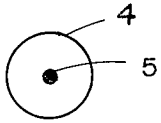
FIG. 4 is a cross-sectional view of the coil of FIG. 3.
Figure 3:
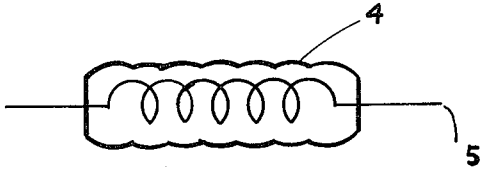
FIG. 3 is the coil of FIG. 2 with an emissive coating on the surface.
Figure 2:
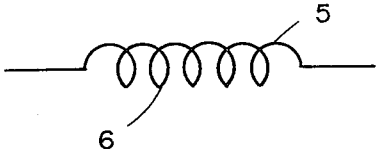
FIG. 2 is a typical fluorescent electrode coil.

FIG. 2 shows an enlarged H.O. type coil 5 having a number of turns 6 of tungsten wire. The emission coating 4 is shown on the surface of the coil 5. The mechanism of adhesion between the emission coating 4 and the coil 5 is not fully understood but is believed to involve Van der Waal type electrostatic forces to a small extent and sintering which occurs when the coil 5 and coating 4 are heated in excess of 1000°C during the lamp making process. The cross-section of the coated coil of FIG. 3 is shown in FIG. 4.

A large quantity of H.O. type fluorescent coil electrodes 5 were then coated with the inventive barium tantalate coating mixture by dip coating the electrodes on standard coating application equipment. After the amyl acetate solvent was sufficiently evaporated from the coated coils 7 the emissive tantalate coating was removed from a statistical sample quantity of lamps and a dry emissive coating weight average value was established for the number of cathodes coated. The same dry coating weight procedure was used for determining the dry average coating weight of the standard triple carbonate material. The average coating weight of the barium tantalate-calcium carbonate mixture for a single coating application was determined to be 40 miligrams. The average coating weight for the triple carbonate mixture was 15 miligrams.

A large number of H.O type fluorescent lamps 1 were then processed into two groups one of which contained the barium tantalate-calcium carbonate coated electrodes and the other contained the triple carbonate coated electrodes. A series of cathode activation parameters were determined for both groups by means of an experimental vacuum and electronic control system in which the temperature of the lamp operating cathode could be determined along with the out-gassing characteristics of the cathode coating material. The equipment also provided means for measuring the resulting lamp ignition and ionization voltages for each group of lamps. The results of this determination showed that the processing time required to activate the standard triple carbonate emissive coating was 60 seconds at a minimum operable coil temperature of 1300°C. The barium tantalate plus calcium carbonate coating was determined to be fully activated at a minimum temperature of 1100°C in 28 seconds. Activation for the purpose of this disclosure is considered to be that condition of an electrode containing an electron emissive coating that will enable a fluorescent lamp to start within a predetermined period of time for a rated lamp starting voltage. It was therefore established that the barium tantalate-calcium carbonate coating with much heavier material weights could be activated in less time than the standard triple carbonate coating.

Figure 6:
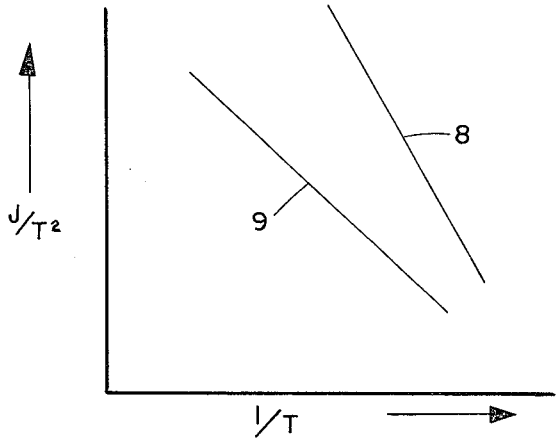
FIG. 6 is a Richardson plot of the inventive coating and the standard coating.

A statistical test quantity of H.O. fluorescent lamps were then processed into two separate groups one of which contained the triple carbonate coating, the other contained the barium tantalate-calcium carbonate coating. An equivalent number of lamps containing each coated electrode type were opened and the coated electrodes were removed from the lamps in order to determine the coating weight of the activated emissive electrode coating. The activated average coating weight for the triple carbonate emissive coating after activation was 12 miligrams representing a 20% reduction in coated weight during the activation process. This weight loss has been determined to be mainly due to the loss of carbon dioxide in the triple carbonate disassociative process in which the resultant product becomes the triple oxides of barium, strontium and calcuium in the same stoichiometric relation to each other as the original triple carbonate mix. The activated barium tantalate coating made was found to be 35 miligrams a weight loss during activation of approximately 12%. Mass spectrographic analysis of the effluent gas during activation showed the loss to be mainly due to water vapor evaporation. The production of 35 miligrams of activated barium tantalate-calcium carbonate therefore represents a substantial increase over the 12 miligrams triple oxide emissive coating that remained after activation with the standard triple carbonate mix. Work function measurements taken in a demountable DIODE system by standard Richardson plot techniques where the ratio of the current density to the square of the cathode temperature is plotted against the reciprocal of the temperature showed the work function of the tantalate-calcium carbonate mixture to be equivalent to or less than the standard emissive coating. Since the electron work function determined by the slope of the curve of FIG. 6 is one measure of electron emission properties, a comparison of the inventive tantalate coating curve 8 to the standard oxide coating 9 indicates therefore that the inventive tantalate carbonate mixture is equally or more emissive than the prior art triple oxide coating.

Figure 5:
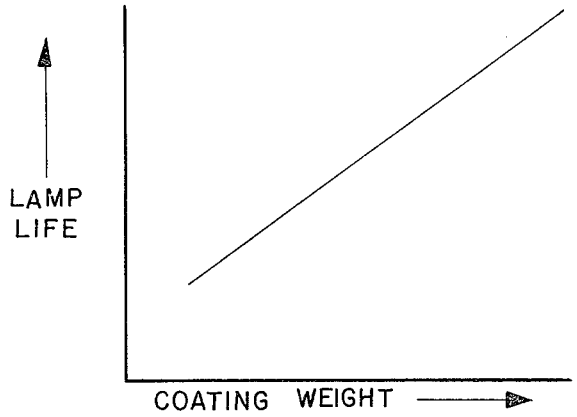
FIG. 5 is a plot of the relation between the lamp life and electrode coating weight.
Figure 7:
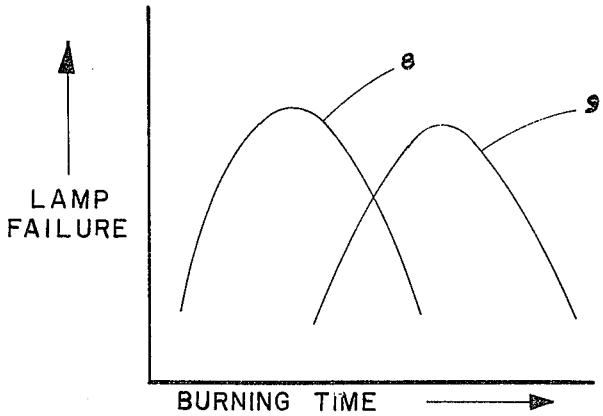
FIG. 7 is a plot of the mortality rate of fluorescent lamps containing the inventive coating and the standard coating.

In order to determine whether the substantial increase in emissive coating weight and equivalent electron emission with the barium tantalate-calcium carbonate coating resulting in increased lamp operating life both groups of lamps were placed on life test cycle operation according to the test standards of the fluorescent lamp industry. The lamps were allowed to burn for a period of 3 continuous hours and were cyclically turned off for 20 minutes each 3 hour operational period until a life determination plot could be obtained for comparison between the groups. The failure rate for the lamps was determined by plotting the mortality rate for groups over extended periods of lamp operation. The plot of the number of lamp failures as a function of burning time is shown in FIG. 7 for the standard oxide coating 8 and the tantalate coating 9 of the instant invention. The results showed that the increased coating weights accomplished with the barium tantalate-calcium carbonate mixture produced longer operating life times than the triple oxide coating. Whether the tantalate-oxide mixture at the same coating weights would result in longer lamp operating life has not as yet been determined. A graphic plot of the relation of predicted lamp life as a function of emissive tantalate coating weight is shown in FIG. 5.

Other emissive coatings consisting of barium, calcium and strontium carbonates with barium tantalate have also been evaluated singly and in combination and have been found to produce larger emissive coating weights on fluorescent lamp electrodes. Other ranges of barium tantalate having barium compositions from 2BaO to 7BaO and tantalum compositions fixed at $Ta_2$ were tested both singly and in combination with ranges in calcium carbonate additions from 5 to 25% for each barium tantalate compound. The electron emission was slightly lower for the barium tantalates having Ba less than 5 and for barium tantalates having Ba greater than 5. The improvement in end discoloration was roughly equivalent over the $CaCaO_3$ range from 5 to 25% for each barium tantalate compound tested. The use of CaO over the same range of 5 to 25% also showed improvements in end discoloration over each barium tantalate range tested, but $CaCO_3$ is preferred as a starting compound for the Ca since it is substantially less air-reactive than the oxide. Whether a particular composition of alkaline earth carbonates and barium tantalate will show unusually low electron work functions similar for example to the particular triple alkaline earth oxide composition of the prior art has not as yet been determined.

Although this embodiment deals specifically with the barium-tantalate-calcium carbonate emissive coating in fluorescent lamps this is intended by way of example only and is not in any way intended to limit the application thereto.

What is claimed is:

1. A method for preparing electron emissive coating for electrical gas discharge devices comprising the following steps:

combining barium carbonate with tantalum pentoxide in the ratio of $5BaCO_3$ to $1Ta_2O_5$;

milling the mixture in a suspension of methyl alcohol for obtaining a homogeneous suspension therein;

drying the suspension and heating for one hour at 800°C and for 2 hours at 1200°C;

cooling and grinding to a powder form; and adding 5 to 25% calcium carbonate and suspending in a solution of nitrocellulose and amyl acetate in order to provide a coating suspension.

2. A method for preparing electron emissive coatings comprising the following steps:

mixing barium carbonate with tantalum peroxide in the ratio of $5BaCO_3$ to $1Ta_2O_5$;

heating the mixture for one hour at 800°C and for 2 hours at 1200°C;

cooling the mixture; and adding 5 to 25% calcium carbonate to the mixture.

* * * * *